United States Patent [19]

Fossan et al.

[11] 4,063,975

[45] Dec. 20, 1977

[54] COLORED COMPOSITION OF EXPLOSIVES

[75] Inventors: Kåre Ragnvald Fossan, Nora; Gunnar Olof Ekman, Gyttorp, both of Sweden

[73] Assignee: Nitro Nobel AB, Gyttorp, Sweden

[21] Appl. No.: 710,549

[22] Filed: Aug. 2, 1976

[30] Foreign Application Priority Data

Sept. 1, 1975 Sweden ..... 7509682

[51] Int. Cl.[2] ..... C06B 25/34

[52] U.S. Cl. ..... 149/92; 149/47; 149/61; 149/105

[58] Field of Search ..... 149/46, 92, 47, 61, 149/105

[56] References Cited

U.S. PATENT DOCUMENTS 3,558,749 1/1971 Rank et al. ..... 149/46

*Primary Examiner*—Stephen J. Lechert, Jr.

*Attorney, Agent, or Firm*—Hane, Roberts, Spiecens & Cohen

[57] ABSTRACT

A stained explosive composition in a water-gelatin base is made from oxidizing salts and at least one water-insoluble hydrocarbon which has dissolved therein a water-insoluble coloring material.

6 Claims, No Drawings

COLORED COMPOSITION OF EXPLOSIVES

The present invention refers to a coloured composition of explosives. Plastic explosives on a nitroglycerine basis have for a long time been of a red colour and the purpose of the colour has been to make it easier to see the explosive both during the production of the explosive and when the explosive is used. Explosives mentioned today are usually called by the general term dynamite, and such an explosive is Dynamex. Such an explosive has a natural light grey colour and had the explosive not been coloured it would have been much more difficult to find the explosive on the field among stone and gravel. In the production it can also be much worse to have uncoloured explosives, as the explosive could end up in an unsuitable place without being observed. Explosives on a nitroglycerine basis are usually coloured by means of pigment or a dye which is solved in the dynamite. Producers of explosives have almost got used to the idea that explosives shall have a red colour, and therefore they demand that also other explosives which are much less dangerous shall also be coloured. The explosives which then come into mind are the explosives which have been made on water gelatine.

A water-gelatine explosive usually consists of suspensions of solid substances in an aqueous, liquid phase. The aqueous phase is a saturated salt solution, which has been thickened or made gelatinous by means of high-polymeric compounds of the type guar gum, starch, CMC (carboxymethylcellulose), etc. The purpose of the gelatine is to give sufficient solidity to the composition and to prevent sedimentation of suspended particles and to increase the resistance against water. In explosives of the last-mentioned type there is an oxidating part consisting of inorganic nitrates, such as ammonium nitrate, calcium nitrate, and sodium nitrate, and there is also a fuel part, which can consist of carbohydrates, hydrocarbon, urea, finely powdered metals, and the like. Because of the above-mentioned practice such water-gelatine explosives have been coloured red, and for that a dye free of water has been used. This has, however, been an obvious disadvantage as the dye free of water in these explosives has coloured everything with which the explosives have come into contact. The staining does not only take place at the place of production but also at the place where the explosive is to be used the person handling the explosive will be stained considerably, and that is a substantial disadvantage. Attempts have been made to use pigment but in order to get sufficient colour intensity it has been necessary to use so large quantities of pigment that it has been impossible to use this method of dyeing a water-gelatine explosive.

The purpose of the present invention is to remove the mentioned drawbacks in connection with the staining. According to the invention this is done by replacing part of the fuel in the water-gelatine explosive by a fuel which is a water-insoluble organic compound. In the mentioned part is dissolved a stain which is hard to dissolve or impossible to dissolve in water. The fuel part is then well dispersed.

Further characteristics applying to the present invention will appear from the following patent claims.

According to the invention part of the fuel of the explosive is replaced by an organic component, which can be a hydrocarbon or hydrocarbons which are in a solid or liquid form, such as paraffin, diesel oil, kerosene, or other similar organic compounds such as ester of high alcohols and acids, triglycerides, chlorinated hydrocarbons, etc. The organic component is a fuel and it is insoluble in water. A stain is dissolved in the component and this stain should then be soluble in oil. Then we can choose among the stains which are used for colouring of petrol and other oil products. An example of a stain is Oil Red A from the firm of Du Pont. The quantity of stain in the organic component can be between 0.05 – 10%. A more narrow quantity of the stain is 0.3 – 0.5%. The organic component can make up about 0.5 – 10% of the whole of the water-gelatine explosive. The recommended quantity of organic component is 1 – 3%.

As sensitizer can be used monomethylaminenitrate, TNT, or other suitable composition.

Successful tests have been made to produce well-coloured water-gelatine explosives.

In the tests there have been explosive compositions of 4 kg, and in the table below is shown the combination of the three explosive compositions made.

EXAMPLE

| Name of the components | Test 1 | Test 2 | Test 3 |
|---|---|---|---|
| $H_2O$ | 8 | 8 | 8 |
| $NH_4NO_3$ | 54 | 50 | 42.5 |
| $NaNO_3$ | 15 | 15.3 | 27 |
| $Ca(NO_3)_2$ | 10 | | |
| monomethylamine nitrate | | 23 | |
| TNT | | | 19 |
| Cane sugar | 4.5 | | |
| Urea | 4.0 | | |
| Parafin oil + stain x) | –3 | 2 | 2 |
| Guar Gum (Meypradex 207) | 1 | 1.2 | 1 |
| Surface active substance | 0.5 | 0.5 | 0.5 |

x) *The stain is Oil Red A from Du Pont(methyl derivative of azobenzene-4-azo-2-naphtol).*

The above explosive compositions have been made in the following way:

A solution consisting of water and inorganic salts (and if desired, of mono-methylamino, nitrate cane sugar, and urea) is arranged and heated to 80°–85° C.

The solution is transferred to a mixing machine and during stirring the surface active substance is added and then guar gum mixed with part of the ammonium nitrate and sodium nitrate, which are included in the recipe.

When the guar gum has been hydrated after a few minutes' stirring the paraffin phase is added and perhaps bikromate solution for cross linkages. (Approx. 2 ml 10-percent solution per kg).

After stirring for a few minutes more the emulsion has been formed and the mass has got a suitable consistency for cartridging.

We claim:

1. A stained explosive composition in a water-gelatin base comprising oxidizing salts and a water-insoluble hydrocarbon or a mixture of water-insoluble hydrocarbons, said hydrocarbon having dissolved therein a water-insoluble coloring material.

2. A composition according to claim 1, which contains sensitizers.

3. A composition according to claim 1, wherein the water-insoluble coloring material is the methyl derivative of azobenzene-4-azo-2-naphthol.

4. A composition according to claim 3, wherein the hydrocarbon or mixture of hydrocarbons is present in about 0.5 to 10% by weight of the total composition.

5. A composition according to claim 4, wherein the water-insoluble coloring material is present in about 0.05 to 10% by weight of the hydrocarbon.

6. A composition according to claim 5, wherein the hydrocarbon is paraffin, diesel oil, kerosene or mixtures thereof.

* * * * *